US007389728B2

(12) United States Patent
Hieronymus et al.

(10) Patent No.: US 7,389,728 B2
(45) Date of Patent: Jun. 24, 2008

(54) PRINTING MACHINE

(75) Inventors: Jens Hieronymus, Darmstadt (DE); Jürgen Michels, Dossenheim (DE); Dieter Schaffrath, Lorsch (DE); Wolfgang Schöneberger, Schriesheim (DE); Bernhard Schwaab, Neustadt (DE); Michael Thielemann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 259 days.

(21) Appl. No.: 11/273,145

(22) Filed: Nov. 14, 2005

(65) Prior Publication Data

US 2006/0096481 A1 May 11, 2006

(30) Foreign Application Priority Data

Nov. 11, 2004 (DE) ..... 10 2004 054 388

(51) Int. Cl.
*B41F 13/20* (2006.01)
*B41F 13/22* (2006.01)

(52) U.S. Cl. ..... 101/479; 101/487; 492/46

(58) Field of Classification Search ..... 101/479, 101/487; 492/46

See application file for complete search history.

(56) References Cited

U.S. PATENT DOCUMENTS

| | | | | |
|---|---|---|---|---|
| 3,633,663 | A * | 1/1972 | Tafel | 165/89 |
| 4,138,778 | A * | 2/1979 | Marzoli | 29/235 |
| 5,535,674 | A * | 7/1996 | Vrotacoe et al. | 101/216 |
| 5,784,957 | A * | 7/1998 | Rau et al. | 101/142 |
| 5,904,642 | A * | 5/1999 | Kusters et al. | 492/16 |
| 6,598,378 | B1 * | 7/2003 | Pottier | 53/556 |
| 6,810,800 | B1 * | 11/2004 | Schneider et al. | 101/217 |
| 6,874,415 | B2 * | 4/2005 | Hoffmann et al. | 101/217 |
| 6,941,861 | B2 | 9/2005 | Bitterich et al. | |

FOREIGN PATENT DOCUMENTS

| | | |
|---|---|---|
| DE | 103 15 191 A1 | 11/2003 |
| EP | 0 733 478 A1 | 9/1996 |

* cited by examiner

*Primary Examiner*—Daniel J. Colilla
*Assistant Examiner*—Marissa L Ferguson-Samre
(74) *Attorney, Agent, or Firm*—Laurence A. Greenberg; Werner H. Stemer; Ralph E. Locher

(57) ABSTRACT

A printing machine includes a roller which is hollow and through which a temperature control liquid flows. The roller is mounted in roller fittings constructed as quick-change devices or quick-acting closures, in such a way that the roller can be quickly removed from the roller fittings and the printing machine and quickly inserted into the roller fittings and the printing machine again, by the operator of the printing machine.

13 Claims, 4 Drawing Sheets

PRINTING MACHINE

BACKGROUND OF THE INVENTION

Field of the Invention

The present invention relates to a printing machine, including a roller which is hollow and through which a temperature control liquid flows.

Such a printing machine is described in European Patent EP 0 733 478 B1. According to that prior art document, the roller is an oscillating distributor roller and is rotationally mounted by its journals in side walls of a machine frame. In that case, removal of the roller from the printing machine by the operator is neither required nor possible.

German Published, Non-Prosecuted Patent Application DE 103 15 191 A1, corresponding to U.S. Pat. No. 6,941,861, describes a printing machine having anilox or engraved or screen rollers which, replacing one another, are inserted into a pair of roller fittings, that are constructed as quick-acting closures. In that case, there is no provision to control the temperature of the anilox rollers through the use of a temperature control liquid.

SUMMARY OF INVENTION

It is accordingly an object of the invention to provide a printing machine which overcomes the hereinafore-mentioned disadvantages of the heretofore-known devices of this general type and in which favorable conditions for constructing the roller as an anilox roller are provided.

With the foregoing and other objects in view there is provided, in accordance with the invention, a printing machine, comprising roller fittings constructed as quick-change devices or quick-acting closures, and a hollow roller through which a temperature control liquid flows. The roller is mounted in the roller fittings. The roller fittings permit the roller to be quickly removed from the roller fittings and the printing machine and permit the roller to be quickly inserted into the roller fittings and the printing machine again, by an operator of the printing machine.

The printing machine according to the invention is advantageously constructed with regard to maintenance of the roller carried out outside the printing machine. For instance, the roller can be an anilox roller having an engraved structure which can in principle be cleaned only outside the printing machine. In addition, the construction of the printing machine according to the invention is advantageous with regard to a change of the roller carried out from print job to print job. For instance, in the case of the construction already mentioned of the roller as an anilox roller, its engraved structure can be suitable for a specific print job and the engraved structure of another anilox roller can be suitable for a following print job, so that one anilox roller is replaced by the other between the two print jobs. The fact that the roller fittings are constructed as quick-change devices or quick-acting closures means that the operator can quickly remove the anilox roller used during the preceding print job from the roller fittings and insert the other anilox roller into the roller fittings.

In accordance with another feature of the invention, the roller and a feed line for conducting the temperature control liquid into the roller are connected fluidically to each other through a line coupling, having a first coupling half and a second coupling half, when the roller is inserted into the printing machine. The roller and the feed line are separated fluidically from each other when the roller is removed from the printing machine.

In accordance with a further feature of the invention, the first coupling half is a first shutoff valve and the second coupling half is a second shutoff valve. The shutoff valves can, for example, be shutoff cocks that can be operated by hand.

In accordance with an added feature of the invention, the first shutoff valve and the second shutoff valve are constructed as self-closing shutoff valves which close automatically when the roller is removed from the printing machine. Therefore, when the roller is removed from the printing machine, one of the shutoff valves substantially prevents the temperature control liquid from emerging from the feed line, and the other of the shutoff valves substantially prevents the temperature control liquid from emerging from the roller.

In accordance with an additional feature of the invention, the first shutoff valve has a sprung, first valve body and the second shutoff valve has a sprung, second valve body. The first coupling half is displaceably mounted in such a way that, when the first coupling half is displaced toward the second coupling half, the first valve body and the second valve body are displaced mutually in order to open the shutoff valves.

In accordance with yet another feature of the invention, the first coupling half is disposed on the feed line and the second coupling half is disposed on the roller. In this case, the feed line can be mounted through at least one rotary bearing in a slide for displacing the feed line and the first coupling half.

In accordance with yet a further feature of the invention, the first coupling half is disposed on the roller and the second coupling half is disposed on the feed line. In this case, the feed line can be a hollow shaft, through which the temperature control liquid flows, for driving the roller in rotation, and a gear can be seated on this hollow shaft. The hollow shaft and the roller can be associated with a driver coupling for transmitting a torque from the hollow shaft to the roller.

In accordance with yet an added feature of the invention, the feed line is a rotary leadthrough, which is located in the printing machine when the roller is removed from the printing machine.

In accordance with a concomitant feature of the invention, the roller is an anilox, engraved or screen roller.

Other features which are considered as characteristic for the invention are set forth in the appended claims.

Although the invention is illustrated and described herein as embodied in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1A:
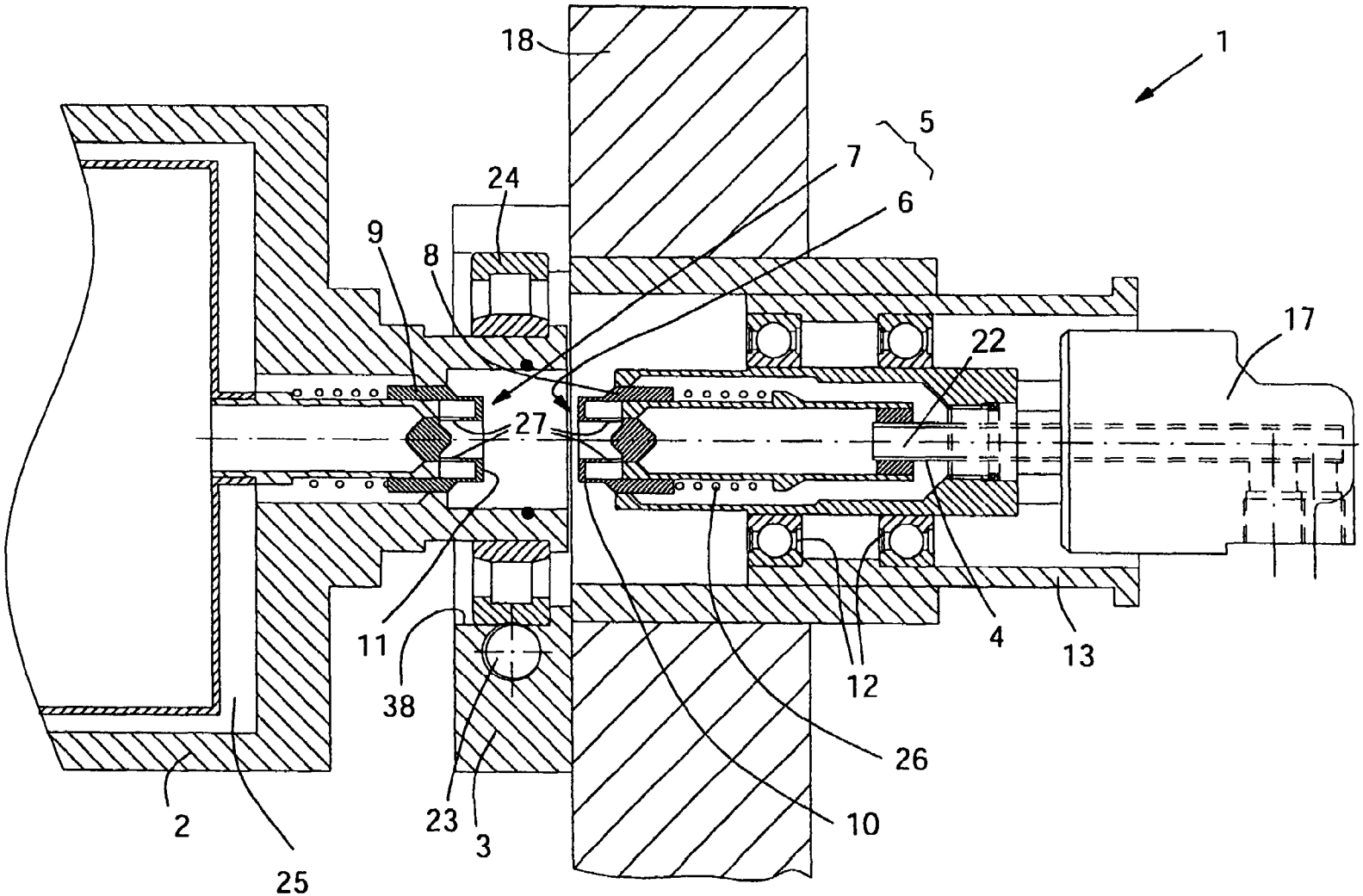
FIGS. 1A and 1B are fragmentary, diagrammatic, sectional views of a first exemplary embodiment of a printing machine, in which a coupling half on a frame side of a line coupling is displaced relative to a coupling half on a roller side as the roller is coupled and uncoupled.
Figure 1B:
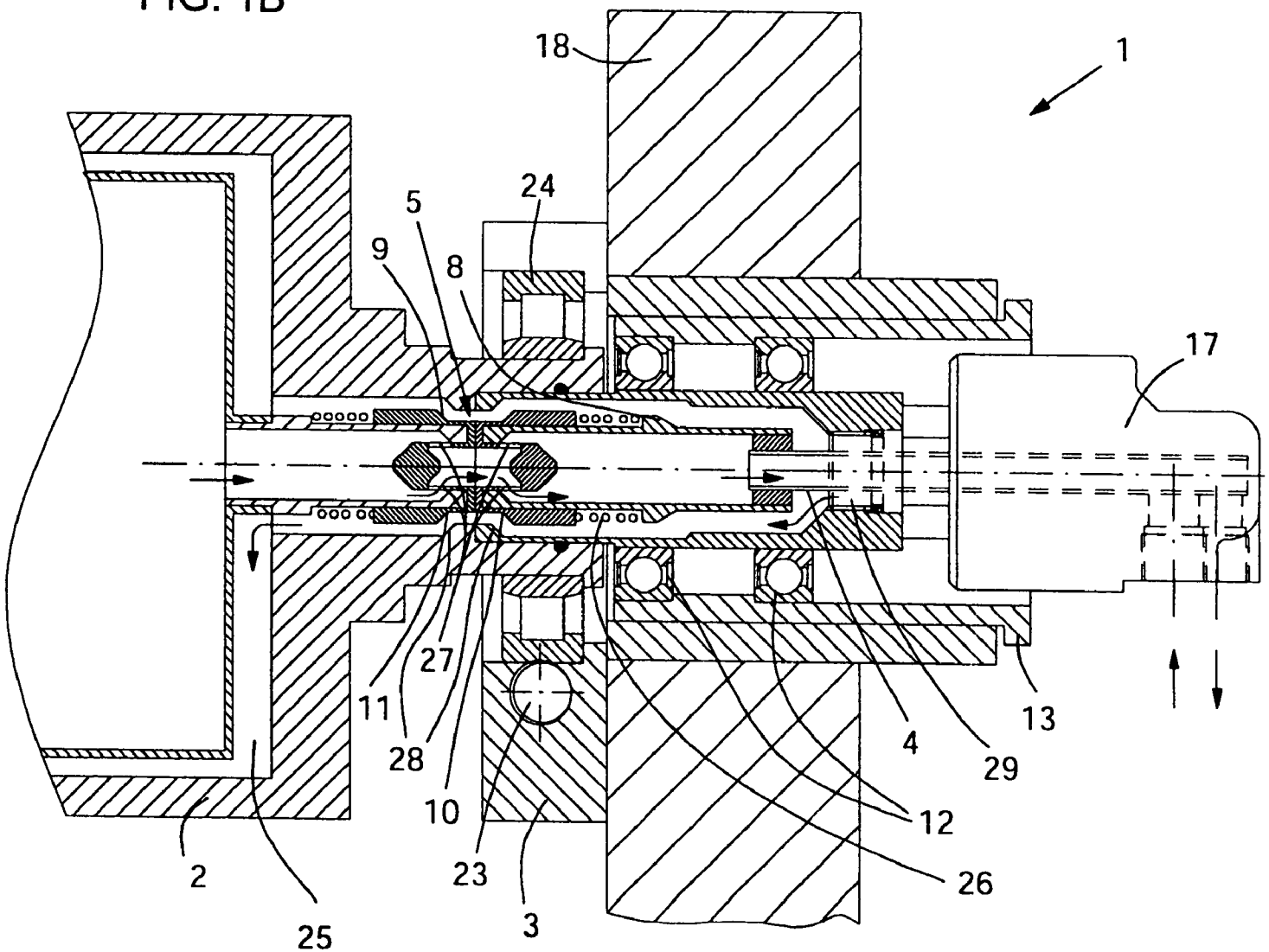

Referring now initially to the common features of the exemplary embodiments shown in the drawings and first, particularly, to FIGS. 1A and 1B thereof, in which mutually corresponding components and elements are designated by the same designations, there is seen a printing machine 1 including a roller 2 which is mounted in roller fittings 3 in such a way that it can be released by an operator. The printing machine 1 is an offset printing machine and the roller 2 is an anilox or engraved or screen roller of an anilox inking unit.

Only one of the roller fittings 3 is illustrated in the drawing. The other roller fitting is constructed mirror-symmetrically with respect to that which is illustrated. The illustrated roller fitting 3 is fitted to a side wall 18 of a machine frame and has a clamping eccentric 23 to secure the roller 2 radially in the roller fitting 3. The clamping eccentric 23 is rotatably mounted in the roller fitting 3 and is rotated by the operator through the use of a socket wrench into a rotary position to secure it. In this rotary position, the clamping eccentric 23 presses an antifriction bearing 24 against two stops of the roller fitting 3, so that the antifriction bearing 24 is clamped in between the clamping eccentric 23 and the stops as in a three-point mounting. The antifriction bearing 24 is seated firmly on an axle journal of the shaft 2.

A rotary leadthrough 17 is a constituent part of a feed line 4, through which a temperature control liquid, preferably water, is pumped into a hollow space 25 inside the roller 2. A line coupling 5 having a first coupling half 6 and a second coupling half 7 is disposed between the feed line 4 and the roller 2. Through the use of the line coupling 5, the roller 2 is connected to a temperature control liquid circuit as desired during roller installation and separated from the circuit again during roller de-installation.

In the following text, the exemplary embodiments will be described separately from one other with a view toward their special features.

In the first exemplary embodiment illustrated in FIGS. 1A and 1B, the feed line 4 is rotatably mounted in a slide 13 by rotary bearings 12. The slide 13 is displaceably mounted in the side wall 18 through a bush-like sliding bearing. A pipe 22 of the rotary leadthrough 17 is plugged into a first shutoff valve 8, which is a constituent part of the first coupling half 6. The first shutoff valve 8 is disposed within the feed line 4. A second shutoff valve 9 is a constituent part of the second coupling half 7, which is formed on the roller 2. Each shutoff valve 8, 9 includes a respective valve body 10, 11, which is mounted in such a way that it can be displaced into a valve position in which the shutoff valve 8, 9 is open, counter to a restoring action of a valve spring 26.

The first exemplary embodiment is based on the following function: After the roller 2 has been inserted into the roller fitting 3 and secured, the slide 13 together with the first coupling half 6 and the first shutoff valve 8 is displaced toward the roller 2, so that the first valve body 10 of the first shutoff valve 8 strikes and presses the second valve body 11 of the second shutoff valve 9, and the valve bodies 10, 11 are displaced mutually into the aforesaid valve position, in which the shutoff valves 8, 9 are open.

Each valve body 10, 11 is constructed as a substantially M-shaped profiled ring and has at least one valve opening 27 in the form of a transverse bore introduced into the inner side or flank of the respective valve body 10, 11. In the valve position provided in order to open the shutoff valve 8 or 9 (see FIG. 1B), the valve body 10, 11 is pressed so deeply into the shutoff valve 8 or 9 that an outer side or flank of the valve body 10, 11 is lifted off a valve seat 28 and the valve opening 27 is no longer separated fluidically from its interior by an edge of the pipe of the shutoff valve 8 or 9.

In the aforesaid valve position, the temperature control liquid flows out of an annular gap 29 of the rotary leadthrough 17 and between the outer sides or flanks of the valve bodies 10, 11 resting on each other and the bead-like valve seats 28 and, subsequently, into the hollow space 25 of the roller 2. The temperature control liquid then flows through the hollow space 25 and flows out of the latter into the interior of the second shutoff valve 9. The temperature control liquid flows through the valve opening 27 in the second valve body 11, out of the interior of the second shutoff valve 9 into an internal space formed jointly by the two valve bodies 10, 11 resting on each other. The temperature control liquid flows from this internal space through the valve opening 27 introduced into the first valve body 10 into the interior of the first shutoff valve 8 and, from the latter, through the pipe 22, back into the rotary leadthrough 17. The flow path of the temperature control liquid is illustrated symbolically through the use of arrows in FIG. 1B.

Figure 2A:
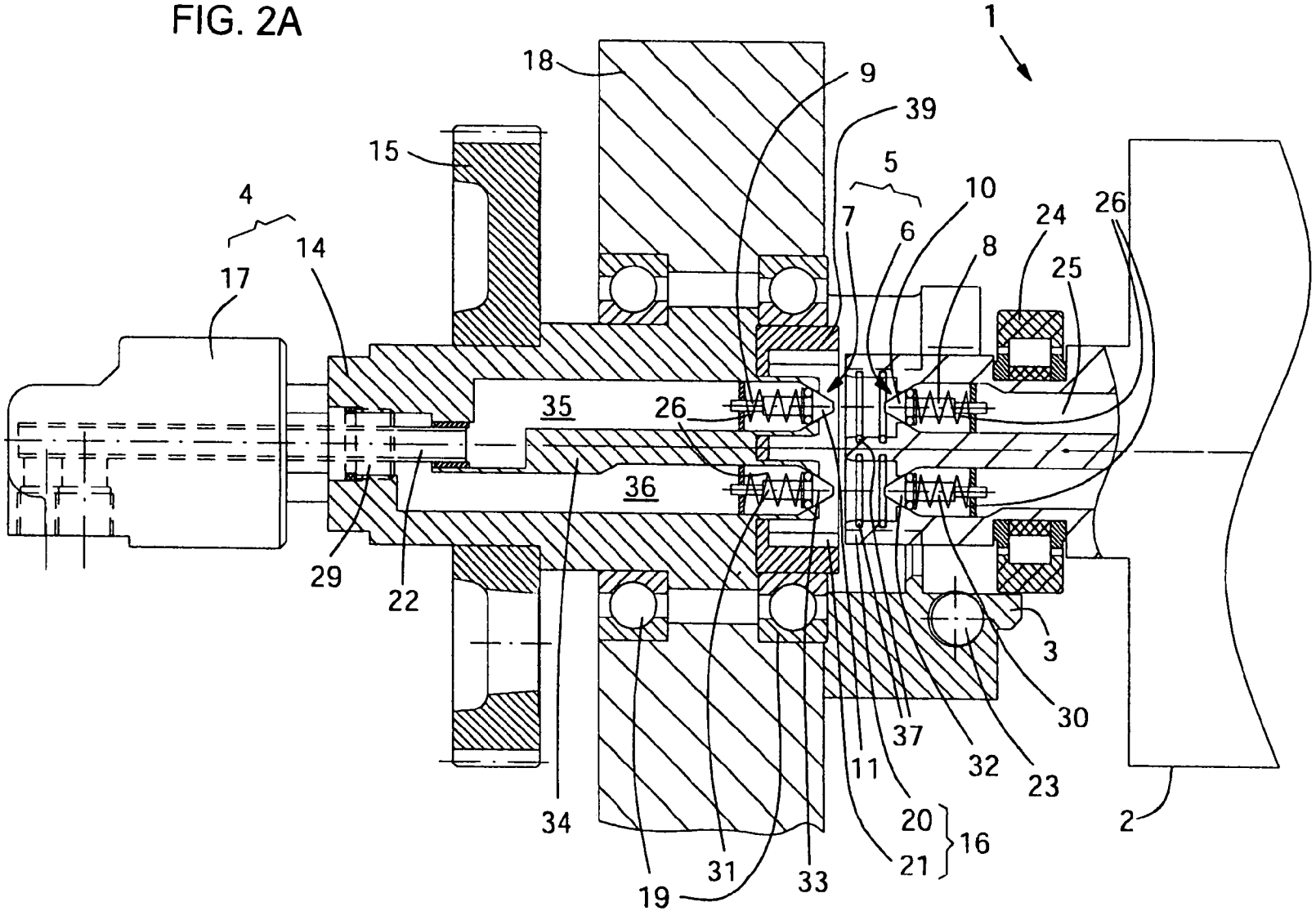
FIGS. 2A and 2B are views similar to FIGS. 1A and 1B of a second exemplary embodiment of the printing machine, in which a coupling half on the roller side of a line coupling is displaced relative to a coupling half on the frame side as the roller is coupled and uncoupled.
Figure 2B:
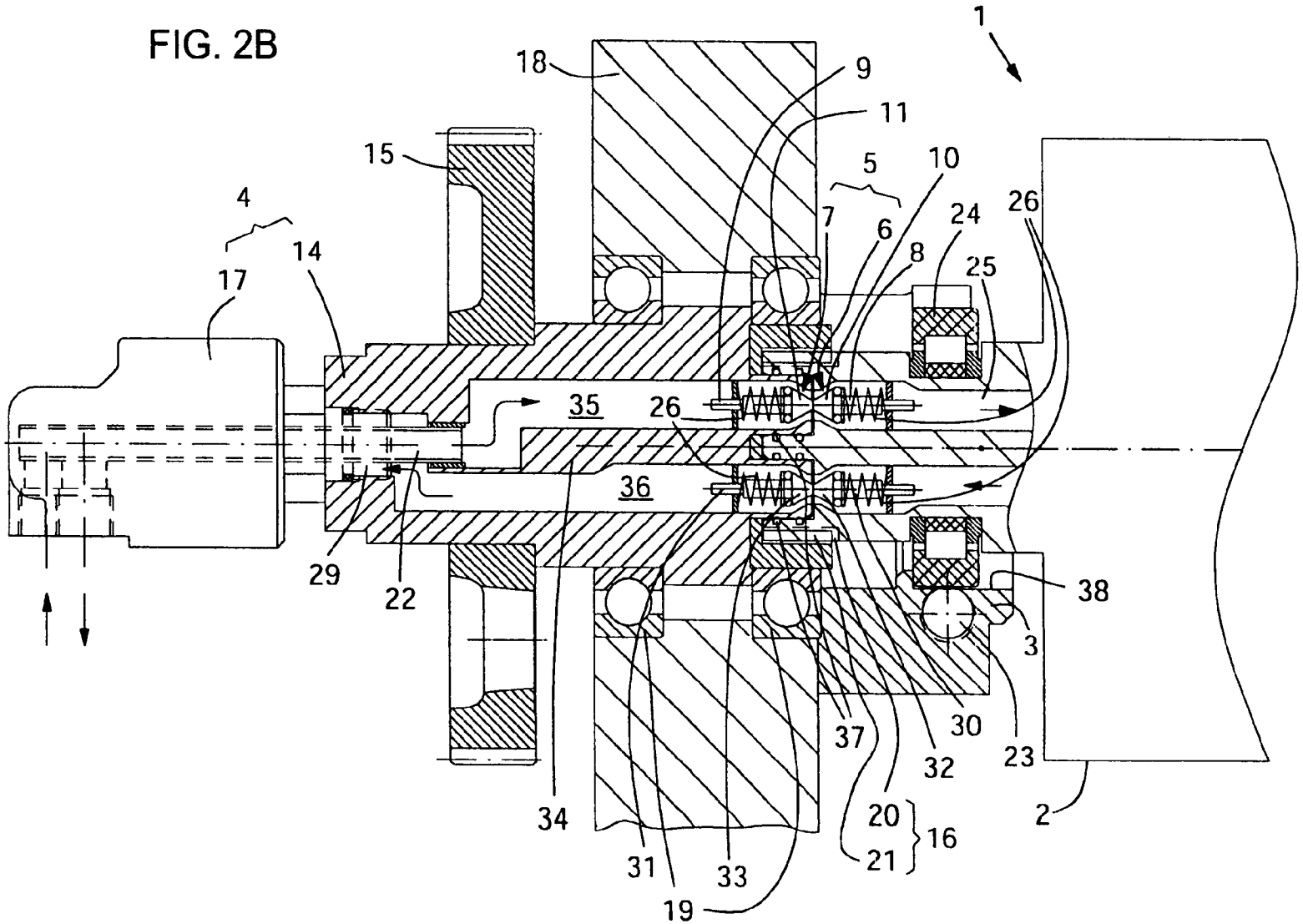

In the second exemplary embodiment illustrated in FIGS. 2A and 2B, a hollow shaft 14 is rotatably mounted in the side wall 18 through rotary bearings 19. A gear 15 is firmly seated on the hollow shaft 14 in order to drive the roller 2 in rotation.

The hollow shaft 14 is subdivided by a dividing wall 34 into a first liquid channel 35 and a second liquid channel 36. The pipe 22 of the rotary leadthrough 17 extends into an inlet of the first liquid channel 35, and the second shutoff valve 9 is disposed in an outlet of the first liquid channel 35. The first shutoff valve 8 is disposed in an extension of the first liquid channel 35 formed in the roller 2. A third shutoff valve 30 is disposed in an extension of the second liquid channel 36, likewise formed in the roller 2. A fourth shutoff valve 31 is disposed in an inlet of the second liquid channel 36, and the annular gap 29 of the rotary leadthrough 17 is connected to an outlet of the second liquid channel 36. The third shutoff valve 30 has a third valve body 32, and the fourth shutoff valve 31 has a fourth valve body 33. The four shutoff valves 8, 9, 30, 31 are identical and the valve bodies 32, 33 are conical or tapered and spring-loaded through the use of valve springs 26, so that the shutoff valves are self-closing. The first coupling half 6 of the line coupling 5 is provided with blind holes, in the bases of which the first valve body 10 and the third valve body 30 are seated in the closed valve position. The second coupling half 7 is provided with hollow plug pins, in the tops of which the second valve body 11 and the fourth valve body 33 are seated in the closed valve position.

When the coupling halves 6, 7 are coupled to each other (see FIG. 2B), the plug pins are plugged with an accurate fit into the blind holes, which are equipped with sealing rings 37, and the first valve body 10 and the second valve body 11 are pressed mutually away from their respective valve seat (blind hole base, plug pin top), so that the temperature control liquid flowing toward the roller 2 can flow out of the second shutoff valve 9 into the first shutoff valve 8. In addition, when the coupling halves 6, 7 are coupled to each other, the third shutoff valve 30 and the fourth shutoff valve 31 are mutually held in the open state, so that the temperature control liquid flowing away from the roller 2 can flow over from the third shutoff valve 30 into the fourth shutoff valve 31. The flow path of the temperature control liquid is illustrated symbolically through the use of arrows in FIG. 2B.

The line coupling 5 is coupled due to the roller 2 with the first coupling half 6 disposed thereon being displaced in the axial direction. This displacement of the roller 2 together with the first coupling half 6 toward the second coupling half 7 on the frame side is carried out at the time at which the antifriction bearing 24 of the roller has already been inserted loosely into the roller fitting 3 but has not yet been secured therein through the use of the clamping eccentric 23. In order to guide the aforesaid axial displacement of the roller 2, a linear guide 38, along which the antifriction bearing 24 slides as far as the clamping eccentric 23, is formed on the roller fitting 3.

As the line coupling 5 is coupled, at the same time a driver coupling 16 is also coupled. In the coupled state, the driver coupling 16 transmits the rotational drive movement from the hollow shaft 14 to the roller 2. The driver coupling 16 is what is known as a shaft-hub connection and includes one or more axial grooves 20 on the outer side of the axle journal of the roller 2 and sliding springs 21 complimentary to the groove or grooves 20 on the inner side of the hollow shaft 20 or, preferably, a ring connected to the hollow shaft 20. When the driver coupling 16 is engaged, the grooves 20 are brought into engagement with the sliding springs 21. A mutually interchanged configuration of the grooves 20 and of the sliding springs 21 is equally possible, as is the construction of the driver coupling 16 as a claw coupling of a different configuration having coupling halves which can be released from each other.

An important advantage possessed by both exemplary embodiments described previously is to be seen in the fact that the temperature control liquid can run neither out of the roller 2 nor out of the feed line 4 when the roller 2 is removed from the roller fitting 3. Without any action on the part of the operator, the shutoff valves prevent any leakage of the temperature control liquid, so that not only is contamination otherwise caused by the temperature control liquid avoided but the volume of the temperature control liquid in the temperature control liquid circuit is also kept constant and frequent topping-off or replenishment of the temperature control liquid is not necessary. From this point of view, the printing machine 1 is therefore very easy to maintain.

This application claims the priority, under 35 U.S.C. § 119, of German Patent Application DE 10 2004 054 388.7, filed Nov. 11, 2004; the entire disclosure of the prior application is herewith incorporated by reference.

We claim:

1. A printing machine, comprising:

roller fittings constructed as quick-change devices or quick-acting closures;

a hollow roller through which a temperature control liquid flows, said roller being mounted in said roller fittings;

said roller fittings permitting said roller to be quickly removed from said roller fittings and the printing machine and permitting said roller to be quickly inserted into said roller fittings and the printing machine again, by an operator of the printing machine;

a feed line for conducting the temperature control liquid into said roller; and a line coupling having a first coupling half being a first shutoff valve and a second coupling half being a second shutoff valve;

said line coupling fluidically interconnecting said roller and said feed line when the roller is inserted into the printing machine, and fluidically separating said roller and said feed line from each other when said roller is removed from the printing machine;

said first shutoff valve and said second shutoff valve being self-closing shutoff valves closing automatically when the roller is removed from the printing machine; and when the roller is removed from the printing machine:

one of said shutoff valves substantially preventing the temperature control liquid from emerging from said feed line, and the other of said shutoff valves substantially preventing the temperature control liquid from emerging from said roller.

2. The printing machine according to claim 1, wherein:

said first shutoff valve has a sprung, first valve body and said second shutoff valve has a sprung, second valve body; and said first coupling half is displaceably mounted causing said first valve body and said second valve body to be displaced mutually for opening said shutoff valves, when said first coupling half is displaced toward said second coupling half.

3. The printing machine according to claim 2, wherein said first coupling half is disposed on said feed line and said second coupling halt is disposed on said roller.

4. The printing machine according to claim 3, which further comprises a slide, and at least one rotary bearing mounting said feed line in said slide for displacing said feed line and said first coupling half.

5. The printing machine according to claim 2, wherein said first coupling half is disposed on said roller and said second coupling half is disposed on said feed line.

6. The printing machine according to claim 5, wherein said feed line is a hollow shaft, through which the temperature control liquid flows, for driving said roller in rotation.

7. The printing machine according to claim 6, which further comprises a gear seated on said hollow shaft.

8. The printing machine according to claim 7, which further comprises a driver coupling associated with said hollow-shaft and said roller for transmitting a torque from said hollow shaft to said roller.

9. The printing machine according to claim 8, wherein said feed line is a rotary leadthrough being located in the printing machine when said roller is removed from the printing machine.

10. The printing machine according to claim 6, which further comprises a driver coupling associated with said hollow shaft and said roller for transmitting a torque from said hollow shaft to said roller.

11. The printing machine according to claim 10, wherein said feed line is a rotary leadthrough being located in the printing machine when said roller is removed from the printing machine.

12. The printing machine according to claim 1, wherein said teed line is a rotary leadthrough being located in the printing machine when said roller is removed from the printing machine.

13. The printing machine according to claim 1, wherein said roller is an anilox roller.

* * * * *